US005529552A

United States Patent [19]

Biedermann et al.

[11] Patent Number: 5,529,552

[45] Date of Patent: Jun. 25, 1996

[54] EXERCISE MACHINE FOR TRAINING BOTH MUSCLE STRENGTH AND CARDIOVASCULAR ENDURANCE

[76] Inventors: Michel Biedermann, 44 Country Hollow La., Haverhill, Mass. 01832; Vladimir Zemlyakov, 19 Independence Dr., Apt. 15, Methuen, Mass. 01844

[21] Appl. No.: 271,112

[22] Filed: Jul. 7, 1994

[51] Int. Cl.[6] ..... A63B 21/22

[52] U.S. Cl. ..... 482/51; 482/70; 482/111

[58] Field of Search ..... 482/51, 70, 71, 482/130, 110, 111, 112, 56, 71, 92, 113

[56] References Cited

U.S. PATENT DOCUMENTS

| | | | |
|---|---|---|---|
| 3,572,700 | 3/1971 | Mastropaolo . | |
| 3,582,069 | 6/1971 | Flick et al. . | |
| 3,596,907 | 8/1971 | Brighton et al. . | |
| 3,874,659 | 4/1975 | Aharoni . | |
| 4,114,875 | 9/1978 | Deluty . | |
| 4,512,571 | 4/1985 | Hermelin . | |
| 4,613,129 | 9/1986 | Schroeder et al. . | |
| 4,659,077 | 4/1987 | Stropkay . | |
| 4,709,918 | 12/1987 | Grinblat | 482/70 |
| 4,720,103 | 1/1988 | Palladino, Jr. . | |
| 4,779,862 | 10/1988 | Keppler | 482/51 |
| 4,867,443 | 9/1989 | Jensen . | |
| 4,951,942 | 8/1990 | Walden . | |
| 5,133,545 | 7/1992 | Moschetti et al. | 482/110 |
| 5,133,700 | 7/1992 | Braathen | 482/51 |
| 5,246,412 | 9/1993 | Chen . | |
| 5,277,678 | 1/1994 | Friedebach et al. . | |
| 5,277,684 | 1/1994 | Harris | 482/130 |

*Primary Examiner*—Stephen R. Crow

[57] ABSTRACT

Disclosed is an exercise machine that allows a person to perform a wide variety of exercises including cardiovascular and strength training. In one embodiment, the apparatus comprises a platform which may be used for a variety of applications. The platform comprises an exercise and/or support surface formed by a plurality of modular members which may be interconnected to decrease or infinitely increase the size of the exercise and/or support surface. The exercise machine further comprises first and second utility arms extending from opposite sides of the support platform. Each of the utility arms comprises an upper segment pivotally connected to a lower segment. The upper segment may comprise one or more pulleys and corresponding cables which may be pulled by the person against a selectable resistance provided by a resistance system embedded within the support platform.

7 Claims, 14 Drawing Sheets

1 - 1

Power Slides

Standard Slide

Arm Power Slide

Trunk Power Slide

Leg Power Slide

Trunk Workouts

Flexion - Extension

Flexion - Extension

Flexion

Lateral Flexion

Lower Body Workout

Hip Extension and Flexion

Knee Flexion - Extension

Hip Adduction - Abduction

Hip Flexion

Upper Body Workout

Shoulder Flexion Extension

Shoulder Flexion Extension

Shoulder Adduction Abduction

Shoulder Horizontal Adduction - Abduction

Miscel. Endurance Exercises

Rowing and Kayaking

Power Walking and X-Country Skiing

Alpine Skiing

Semi-Recumbent Cycling

Miscel. Other Exercises

Squats

Swimming

Baseball, Hockey Golf, and Tennis Hits

Baseball Pitch, Shot Put, Javelin and Miscel. Throws

Beginner's Exercise

Safety Setup for Therapy or for Beginners

EXERCISE MACHINE FOR TRAINING BOTH MUSCLE STRENGTH AND CARDIOVASCULAR ENDURANCE

FIELD OF THE INVENTION

The present invention relates generally to exercise machines and more particularly, to exercise machines which allow a person to perform a wide variety of exercises for fitness, rehabilitation, diagnostic and/or therapeutic purposes.

BACKGROUND OF THE INVENTION

It is well known that exercise is an important part of a person's overall health. Numerous exercise equipment have been developed which allow a person to exercise. Such conventional equipment has also been used for rehabilitation and therapeutic applications. As will be described herein, such conventional equipment does not meet the demands of an ideal exercise program and is not adapted to enhance the rehabilitation or diagnosis of an injured person. Generally, there are three components to providing a person with an ideal exercise program. The first component is commonly referred to as "cardiovascular" or "endurance training." Cardiovascular exercise can be described as rhythmic and repetitive exercise done for long periods of time (at least 20 minutes) and involving large muscle groups. Examples include cycling, cross-country skiing, running, and walking. Before attempting an endurance training regimen, a baseline test must be performed to assess a person's ability to be safely trained and to allow accurate monitoring of his progress. Conventional exercise machines of this type do not have a resistance mechanism capable of delivering a stable and exact load in order to obtain reliable medical and research data.

The second component is commonly referred to as "strength training." Increasing a person's strength and consequently the person's muscle mass requires overloading the various muscles. Conventional exercise machines provide this component by requiring the person to lift heavy weights or strain against resistance.

The third component is referred to as "coordination." This is an important part of any exercise regimen and helps to prevent injuries.

Finally, an adjunct to any exercise program is compliance which may be generally defined as the incentive of a person to exercise. In that even the best designed exercise equipment will only be as successful as the motivation of the person using the equipment, compliance should be an important design element of any exercise machine. There are several factors that enhance the compliance of a person to exercise, including fun, variety, and safety.

No single conventional exercise machine is capable of providing an exercise program with all of the above features, namely, cardiovascular training, strength training, coordination, and compliance.

Furthermore, in instances where a person has suffered an injury which affects the movement of a body limb, there is a need to rehabilitate the affected muscles and joints in order to allow the person to regain normal body motion. As part of the rehabilitation process, it is important to monitor the progress of the injured person so that the exercise program may be varied to best suit the patient's particular needs. Conventional exercise equipment are not particularly adapted to serve the dual purpose of allowing a person to exercise for fitness and/or therapy.

One object of the present invention is to develop an exercise machine that is capable of providing anyone with the tools to reach their health and fitness goals.

Another object of the present invention is to develop an exercise machine that can be easily adapted to meet the ergonomic profile of any person.

Another object of the present invention is to develop an exercise machine that can be used for rehabilitation, therapeutic, and diagnostic purposes.

SUMMARY OF THE PRESENT INVENTION

In one embodiment the exercise machine of the present invention comprises a support platform which may be used for a variety of applications. The support platform comprises an exercise and/or support surface formed by a plurality of modular members which may be interconnected to increase or decrease the size of the exercise surface. The exercise machine further comprises first and second utility arms extending from opposite sides of the support platform. Each of the utility arms comprises an upper segment pivotally connected to a lower segment. The upper segment may comprise one or more pulleys and corresponding ropes which may be pulled by a person against a selectable resistance provided by an accommodating resistance system embedded within the support platform. The resistance system includes a hydraulic chamber filled with an incompressible fluid medium, a piston, a channel, and a relief valve, whereby one can selectively change the resistance in infinitely small increments.

The modular nature of the support platform and the pivotable feature of the first and second utility arms allows a person to select from a variety of resistance or strength training exercise programs. Moreover, the exercise machine of the present invention can be easily adjusted to meet the ergonomic profile of the person.

BRIEF DESCRIPTION OF THE DRAWINGS

The following detailed description of the present invention will be better understood with reference to the accompanying drawings in which.

DETAILED DESCRIPTION OF THE PREFERRED EMBODIMENTS

Figure 1:
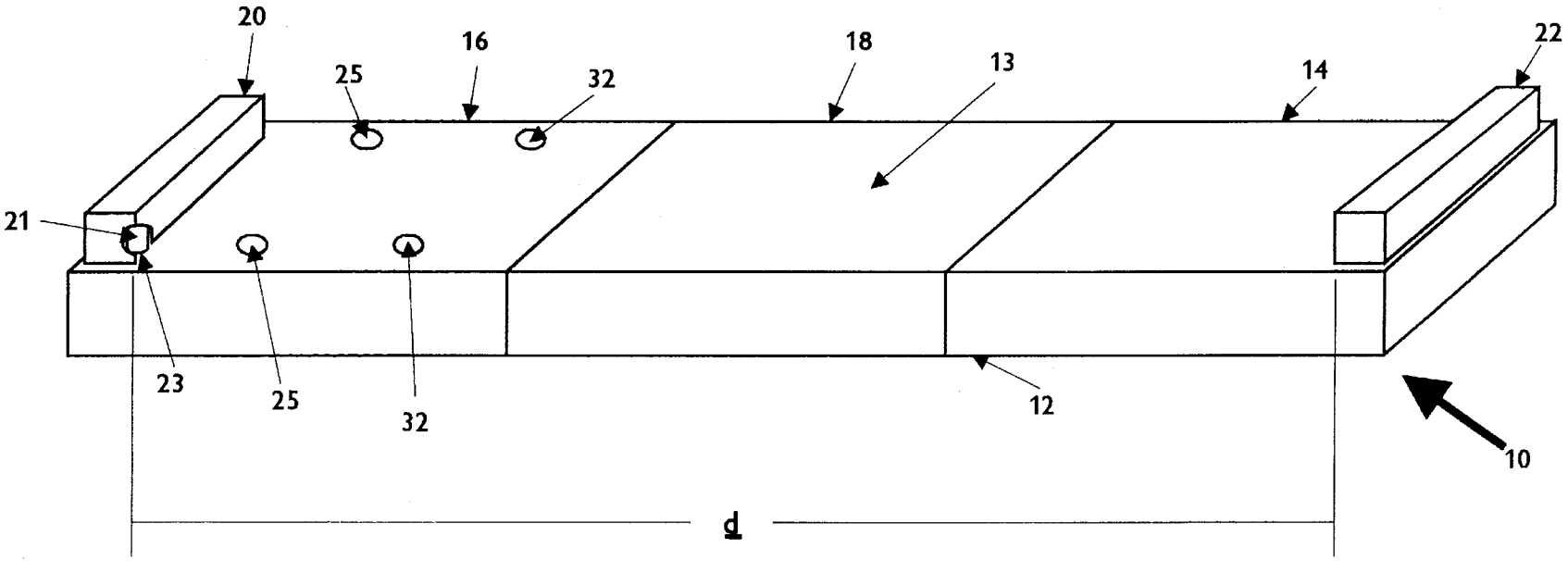
FIG. 1 is a perspective view of one embodiment of the exercise machine of the present invention.

Referring to FIG. 1 wherein one embodiment of the exercise machine 10 of the present invention is shown. In this embodiment, the exercise machine 10 generally comprises a platform 12 which may be used for a variety of applications. The platform 12 is formed by a number of modular members which in the preferred embodiment comprises end sections 14 and 16 and a middle section 18 which may be interconnected by conventional means. Alternatively, platform 12 may have an infinite number of middle sections 18 so that the overall length of the platform 12 may be increased or decreased as necessary to fit the needs and/or ergonomic profile of the person using the exercise machine 10. The end sections 14 and 16 and the middle section 18 form an upper exercise and/or support surface 13 which may be used for a variety of applications.

In one application, the platform 12 may be used by a person to perform an exercise routine known as "sliding." In this application, the exercise surface 13 may be made from a variety of materials such that it has a relatively low coefficient of friction when contact is made with a woven material. As such, a person wearing a woven sock on their feet may slide on the exercise surface 13 to perform the sliding exercise. Exercise surface 13 may be integral to the end sections 14 and 16 and the middle section 18 or may be a separate material which is laid over each member or the assembly of the platform 12. The exercise machine 10 may further comprise a stop member 20 which may be selectively connected to a variety of positions along the length of the end section 16. Stop member 20 may comprise a pair of protrusions 21 that may be inserted into a pair of openings 23, 25 or 32 disposed along the upper surface of the end module 16 to secure the stop member 20 in a selected position. The exercise machine 10 may further comprise a stop member 22 that is disposed at one end of the end section 14. The distance between stop member 20 and stop member 22 define a sliding distance d. The sliding distance d may be selectively adjusted to meet the ergonomic profile of the person. This may be accomplished by one of several ways. For fine adjustment, the person may reposition the stop member 20 to any one of a variety of positions defined by the pair of openings 23, 25 and 32. Alternatively or in addition to, a person may remove the middle section 18 or add additional middle sections (not shown) the result of which is to either infinitely increase and/or decrease the sliding distance d.

Figure 2:
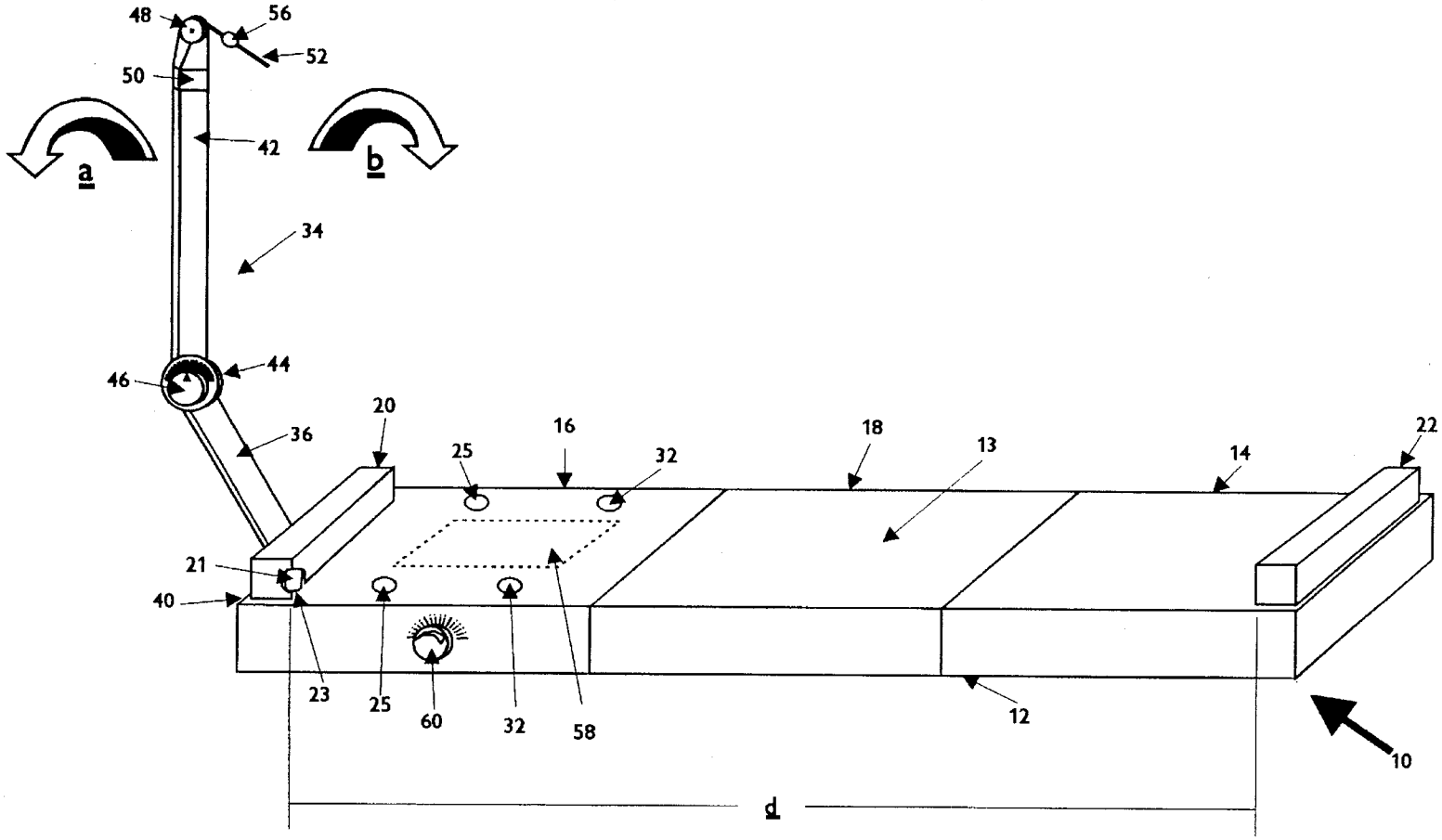
FIG. 2 is a perspective view of a second embodiment of the exercise machine of the present invention.

Referring to FIG. 2, wherein another embodiment of the exercise machine 10 is shown. In this embodiment, the exercise machine 10 may further comprise a first utility arm 34 which is selectively movable with respect to the platform 12 and exercise surface 13. As will be more fully described herein, the first utility arm 34 may be used by a person to perform a variety of resistance exercises. In the preferred embodiment, the first utility arm 34 comprises a lower segment 36 made of tubular and rigid construction and having an end 38 (FIG. 9) which is connected outwardly by conventional means, such as bolts, to an end 40 of the end section 16. Although not shown, the lower segment 36 is preferably pivotally mounted to the end 38 so that the first utility arm 34 may be retracted or otherwise moved for storage of the exercise machine 10.

The first utility arm 34 further comprises an upper segment 42 which is pivotally connected to the other end of the lower segment 36 by a pivot joint 44. The upper segment 42 is also made of tubular and rigid construction. The pivot joint 44 is provided with a release mechanism 46 which when tightened fixes the position of the upper segment 42 with respect to the lower segment 36 and when loosened allows the upper segment 42 to be moved relative to the lower segment 36. As shown by arrows a and b, the upper segment 42 may be pivoted through an arc of substantially 360 degrees ranging from a position where the upper segment 42 is extending outward and substantially downward with respect to the platform 12 to a position wherein the upper segment 42 is extending inward and substantially downward to the platform 12. This feature of the exercise machine 10 provides a person with a wide selection of exercises and assists in meeting the ergonomic profile of the person.

The exercise machine 10 further comprises a pulley 48 rotatably attached to the upper end 50 of the upper segment 42 and adapted to movably support a cable or cord 52 positioned therein. The cable 52 may be made from a variety of materials such as nylon rope, wire, cable or the like. One end of the cable 52 is provided with a restraining ball 56 which is adapted to prevent the cable 52 from being accidentally removed from the pulley 48. The cable 52 extends through pulley 48 and into and down the upper segment 42 and lower segment 36 to an accommodating resistance system 58 (to be described) of the present invention which is preferably embedded within the platform 12. A person may select the resistance of the accommodating resistance system 58 by turning a knob 60 or using a computerized system (to be described).

Figure 3:
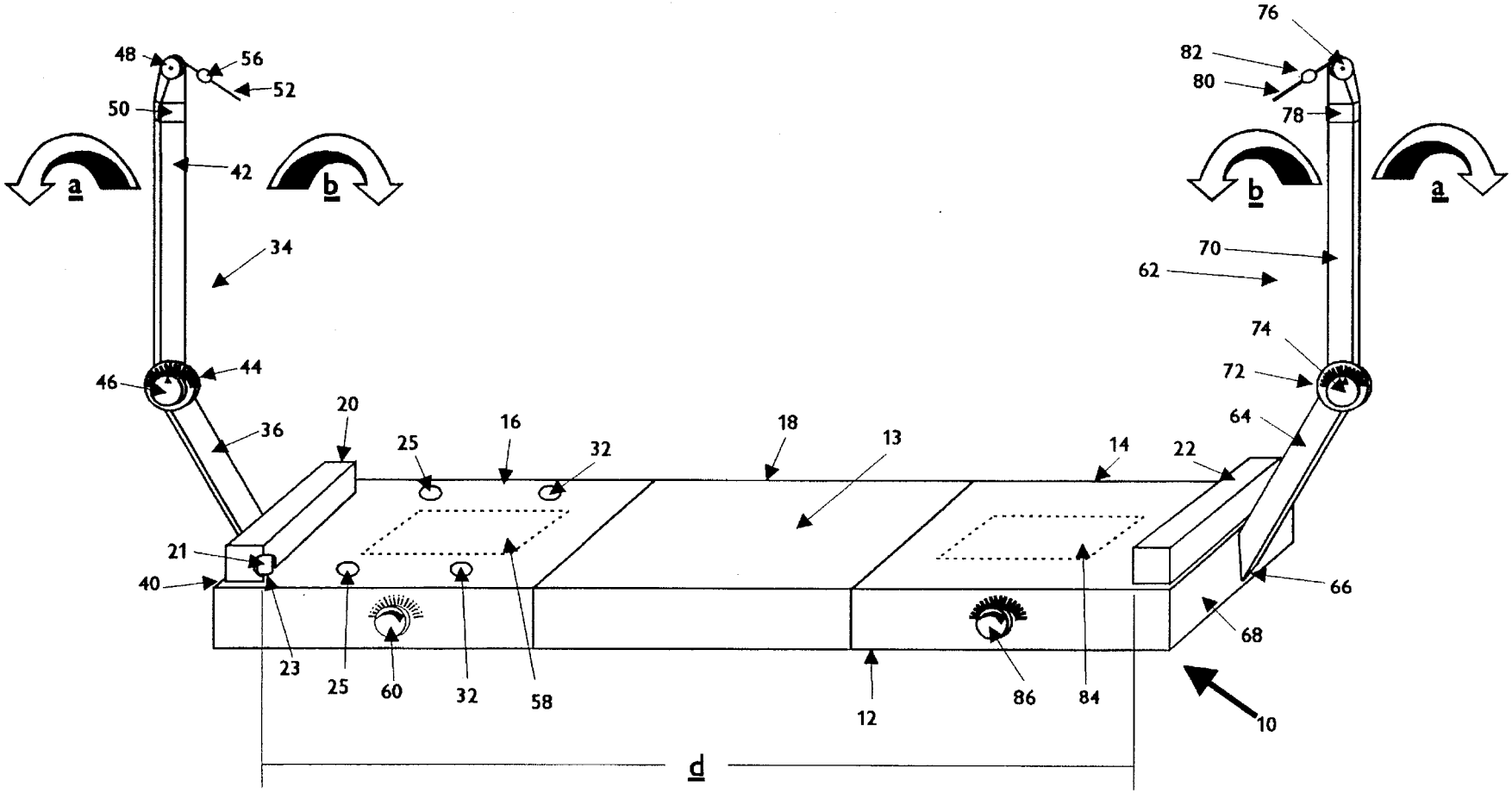
FIG. 3 is a perspective view of a third embodiment of the exercise machine of the present invention.

Referring to FIG. 3, where another embodiment of the exercise machine 10 is shown. In this embodiment the exercise machine 10 may further comprise a second utility arm 62 which in the preferred embodiment is constructed the same and operates the same as the first utility arm 34. The second utility arm 62 is likewise pivotable with respect to the support platform 12. In the preferred embodiment, the second utility arm 62 comprises a lower segment 64 made of tubular and rigid construction and having an end 66 which is connected outwardly by conventional means, such as bolts, to an end 68 of the end section 14. Although not shown, the lower segment 64 is preferably pivotally mounted to the end 68 so that the second utility arm 62 may be retracted or otherwise moved for storage of the exercise machine 10. The second utility arm 62 further comprises an upper segment 70 made of tubular and rigid construction which is pivotally connected to the other end of the lower segment 64 by a pivot joint 72. The pivot joint 72 is provided with a release mechanism 74 which when tightened fixes the position of the upper segment 70 with respect to the lower segment 64 and when loosened allows the upper segment 70 to be moved relative to the lower segment 64.

The exercise machine 10 further comprises a pulley 76 rotatably attached to the upper end 78 of the upper segment 70 and which is adapted to movably support a cable or cord 80 therein. One end of the cable 80 is provided with a restraining ball 82 to prevent the cable 80 from being accidentally removed from the pulley 76. The cable 80 extends through pulley 76, into and down the upper segment 70 and lower segment 66 to an accommodating resistance system 84 (to be described) embedded within the end section 14. A person may select the resistance of the accommodating resistance system 84 by turning a knob 86.

Muscles always work in coordinated pairs. For every contracting muscle, called the "agonist," that causes a joint to move in one direction, there is a muscle in opposition, called the "antagonist," which when contracting would move the joint in the opposite direction. An example of this would be a person lifting a hand-held twenty pound (20 lb) weight. The biceps, the contracting muscle causing the elbow joint to flex, is the agonist. The triceps, a muscle situated on the back of the upper arm and opposite the biceps, is the antagonist. In order to smoothly lift the weight, the agonist muscle must contract and the antagonist must relax. Any contraction by the antagonist would be counter-productive. This mutually opposite state of excitement or contraction is called "reciprocal inhibition."

With the exercise machine 10 of the present invention, a person may use both of the cables 52 and 80 to exercise both the "agonist" and "antagonist" muscles in a single movement. That is, the role of each opposing muscle group will shift back and forth between being an agonist and antagonist depending upon the direction of the motion. The agonist muscle in one direction will become the antagonist muscle in the opposite direction and vice-versa. Conventional exercise equipment does not allow both of the opposing muscle groups to be worked in one full movement.

Figure 4:
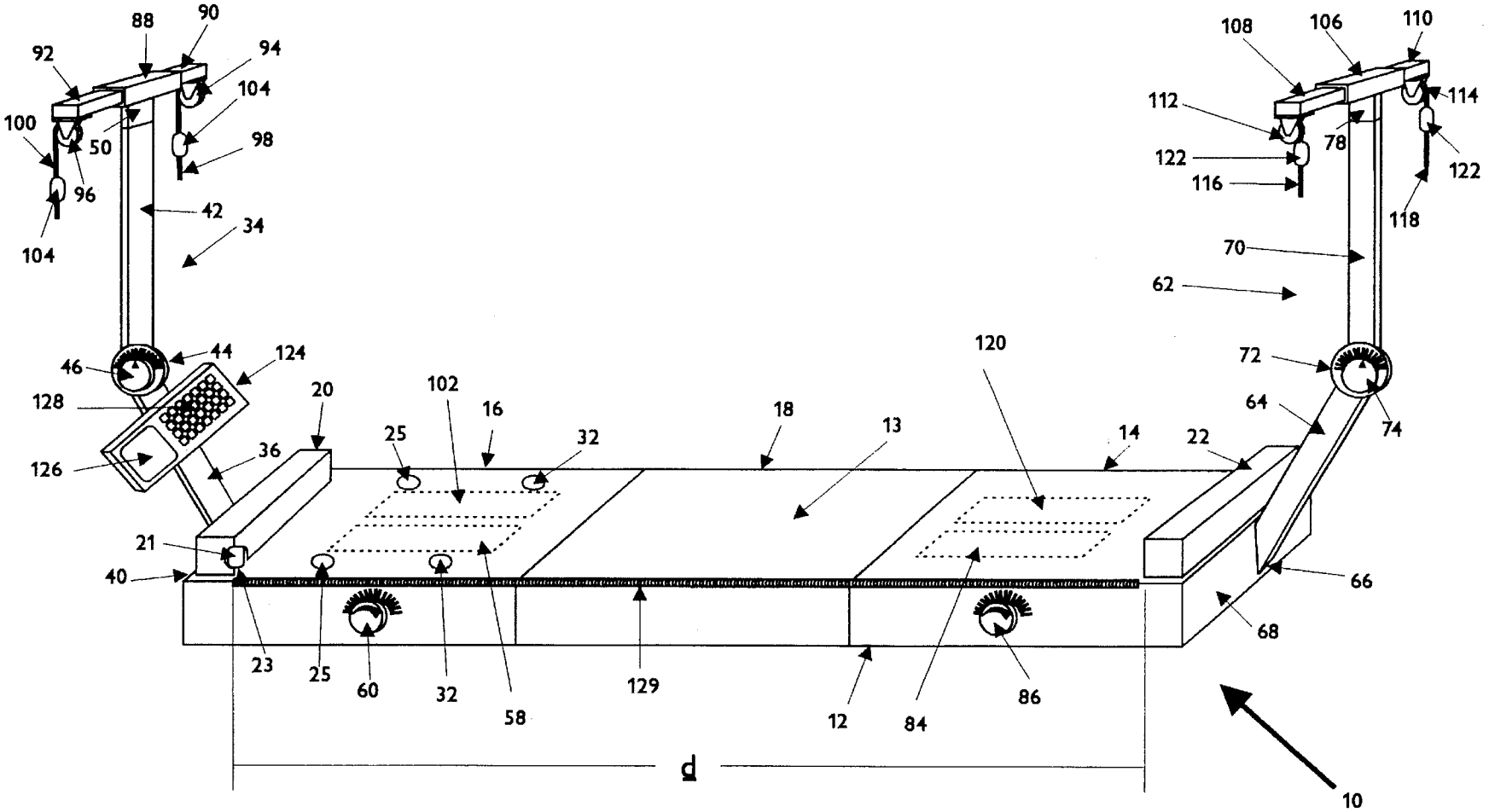
FIG. 4 is a perspective view of a fourth embodiment of the exercise machine of the present invention.

Referring to FIG. 4, wherein another embodiment of the exercise machine 10 of the present invention is shown. In this embodiment, the exercise machine 10 may further comprise a horizontal support arm 88 rotatably connected to the upper end 50 of the upper segment 42 of the first utility arm 34. The horizontal support arm 88 may comprise extension members 90 and 92 which may be moved telescopically inward and outward of the horizontal support arm 88. The exercise machine 10 may further comprise a first pulley 94 rotatably attached to the lower surface of the extension member 90 and a second pulley 96 rotatably attached to the lower surface of the extension member 92. A cable or cord 100 is positioned within the pulley 96. One end of the cable 100 is provided with a restraining ball 104 to prevent the cable 100 from being accidentally removed from the pulley 96. The cable 100 extends through pulley 96, through the extension member 92 and the horizontal support arm 88 and into and down the upper segment 42 and lower segment 36 to the accommodating resistance system 58. Similarly, a cable or cord 98 is positioned within the pulley 94. One end of the cable 98 is provided with another restraining ball 104 to prevent the cable 98 from being accidentally removed from the pulley 94. The cable 98 extends through pulley 94, through the extension member 90 and the horizontal support arm 88 and into and down the upper segment 42 and lower segment 36 to a another accommodating resistance system 102. A person may select the resistance of the second accommodating resistance system 102 by turning a knob (not shown) located on the end section 16.

The exercise machine 10 may further comprise a second horizontal support arm 106 rotatably connected to the upper end 78 of the upper segment 70 of the second utility arm 62. The second horizontal support arm 106 comprises extension members 108 and 110 which may be moved telescopically inward and outward of the second horizontal support arm 106. The exercise machine 10 may further comprise a third pulley 112 rotatably attached to the lower surface of the extension arm 108 and a fourth pulley 114 rotatably attached to the lower surface of the extension arm 110. A cable or cord 116 is positioned within the pulley 112. One end of the cable 116 is provided with a restraining ball 122 to prevent the cable 116 from being accidentally removed from the pulley 112. The cable 116 extends through pulley 112, through the extension member 108 and the horizontal support arm 106 and into and down the upper segment 70 and lower segment 64 to the accommodating resistance system 84. Similarly, a cable or cord 118 is positioned within the pulley 114. One end of the cable 118 is provided with another restraining ball 122 to prevent the cable 118 from being accidentally removed from the pulley 114. The cable 118 extends through pulley 114, through the extension member 110 and the horizontal support arm 106 and into and down the upper segment 70 and lower segment 64 to a fourth accommodating resistance system 120. A person may select the resistance of the second accommodating resistance system 120 by turning a knob (not shown) located on the end section 14.

The exercise machine 10 may further comprise a computer system 124 having a display screen 126 and keyboard 128. The computer system 124 may be used for a variety of applications such as to monitor various physiological parameters of a person such as heart rate and blood pressure or key in specific exercise parameters such as resistance settings, exercise time, etc. The exercise machine 10 may further comprise a sensor (not shown) connected to the computer system 124. The sensor could take a variety of forms including a sensor adapted to monitor the electrical impulses generated by the person's body during muscle contraction and to output a signal indicative of the same to the computer system 124. Alternatively, the sensor could be worn by the person and adapted to transmit a wireless signal to a receiver provided within the computer system 124.

The computer system 124 may also be used to provide a pacing count for the person. The pacing count may for example be auditory through a speaker provided within the computer system 124 or visually displayed on the display screen 126 or on a strap with LED's 129 attached to the edge of the exercise surface 13.

The computer system 124 may also be used to provide the person with accurate information relating to force exerted, work or calories, and number of cycles performed. For example, a sensor (not shown) could be provided within each of the stop members 20 and 22 which would measure not only the number of times the person touched the stop members, but also the force which the person exerted upon the stop members. The sensor could output a signal to the computer system 124 indicative of the force exerted by the person as well as the number of cycles completed. With this information, the computer system 124 could determine and thereafter display the force exerted by the person, the distance traveled by the person, and total calories burned by the person.

The computer system 124 may also be used to provide information in conjunction with resistance exercises. In this application, a sensor could be provided within the resistance system such that the velocity of the cable as well as the total distance traveled by the cable could be measured. With this information, the computer system 124 could provide feedback to the person exercising. Alternatively, the computer system 124 could be used to simply provide bio-feedback to the person for stress level reduction without exercising.

Moreover, the computer system 124 may also be used in an interactive mode in connection with various games and/or sports. By way of example only, the computer system 124 may be used to play a game wherein the person's motion is interactive with a game being executed within the computer system and displayed on the display screen 126. This feature of the computer system 124 makes exercise more fun and thus enhances the compliance of the exercise machine 10.

The exercise machine 10 may also be used for rehabilitation, therapeutic and/or diagnostic purposes. For example, consider the situation where a person has lost substantial mobility in one of their arms. In this situation, the injured limb must be exercised to regain mobility. With the exercise machine 10, one cable could be connected to the person's lower arm while a second cable could be connected the person's upper arm. In this configuration, the exercise machine 10 could be used to not only to exercise the injured limb but to monitor the relative movements of the upper and lower arm and to provide a progress report of the same. In response to the information provided by the exercise system 10, a therapist could adjust the person's rehabilitation program to meet the specific needs of the injured person.

Figure 5:
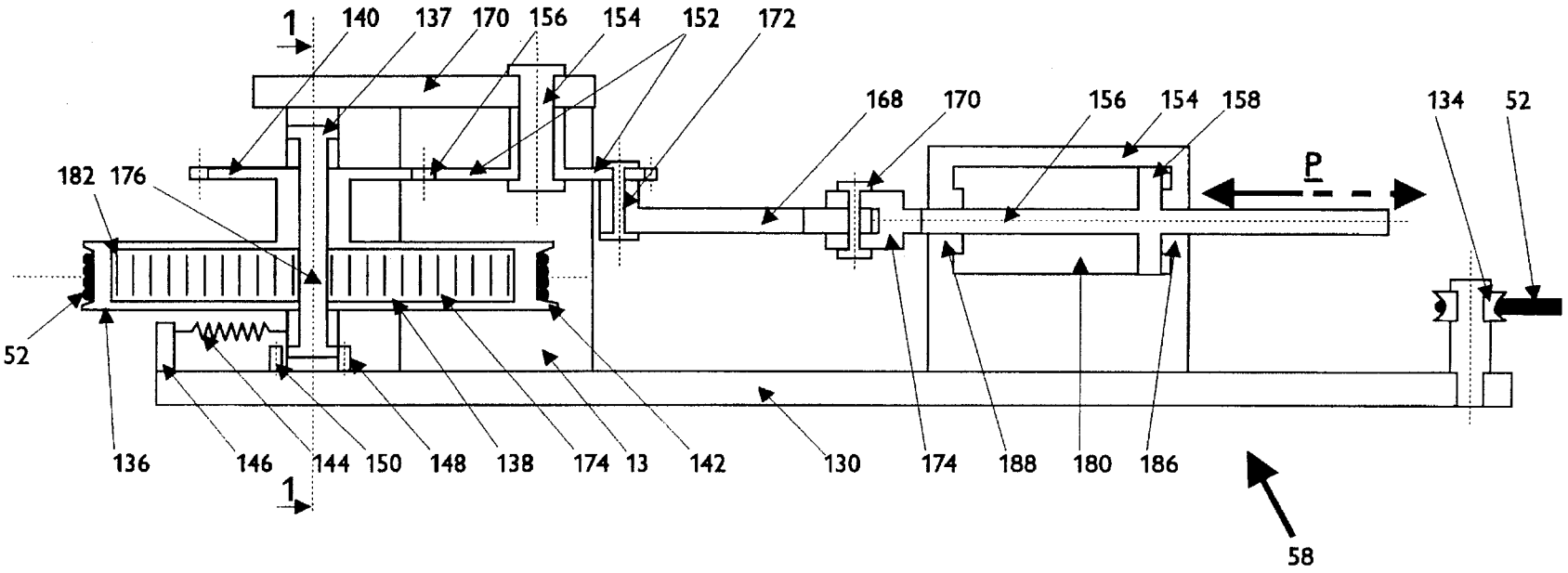
FIG. 5 is cross-section view of the accommodating resistance system of the present invention.
Figure 6:
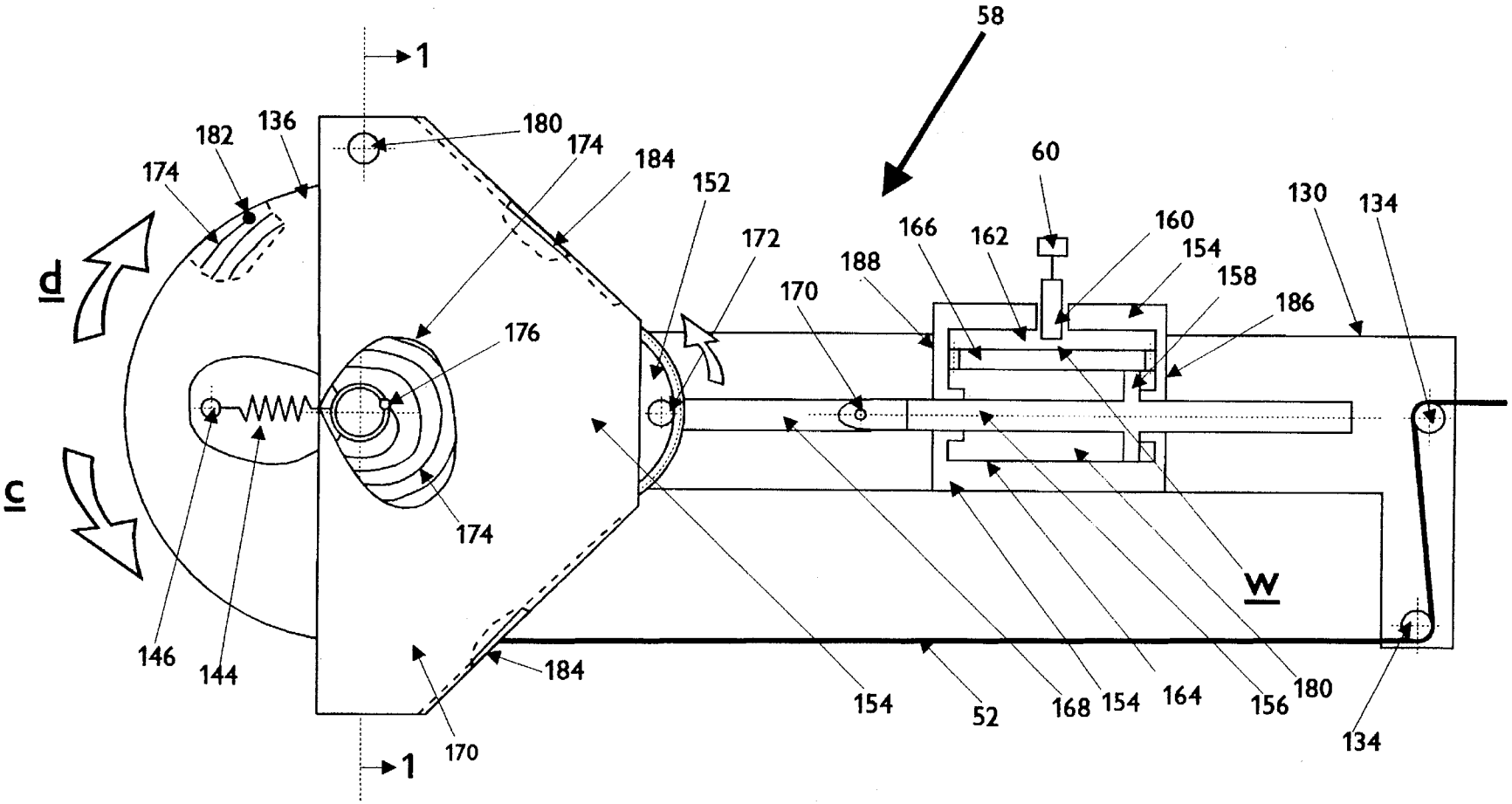
FIG. 6 is a top cross-section and cut-away view of the accommodating resistance system.
Figure 7:
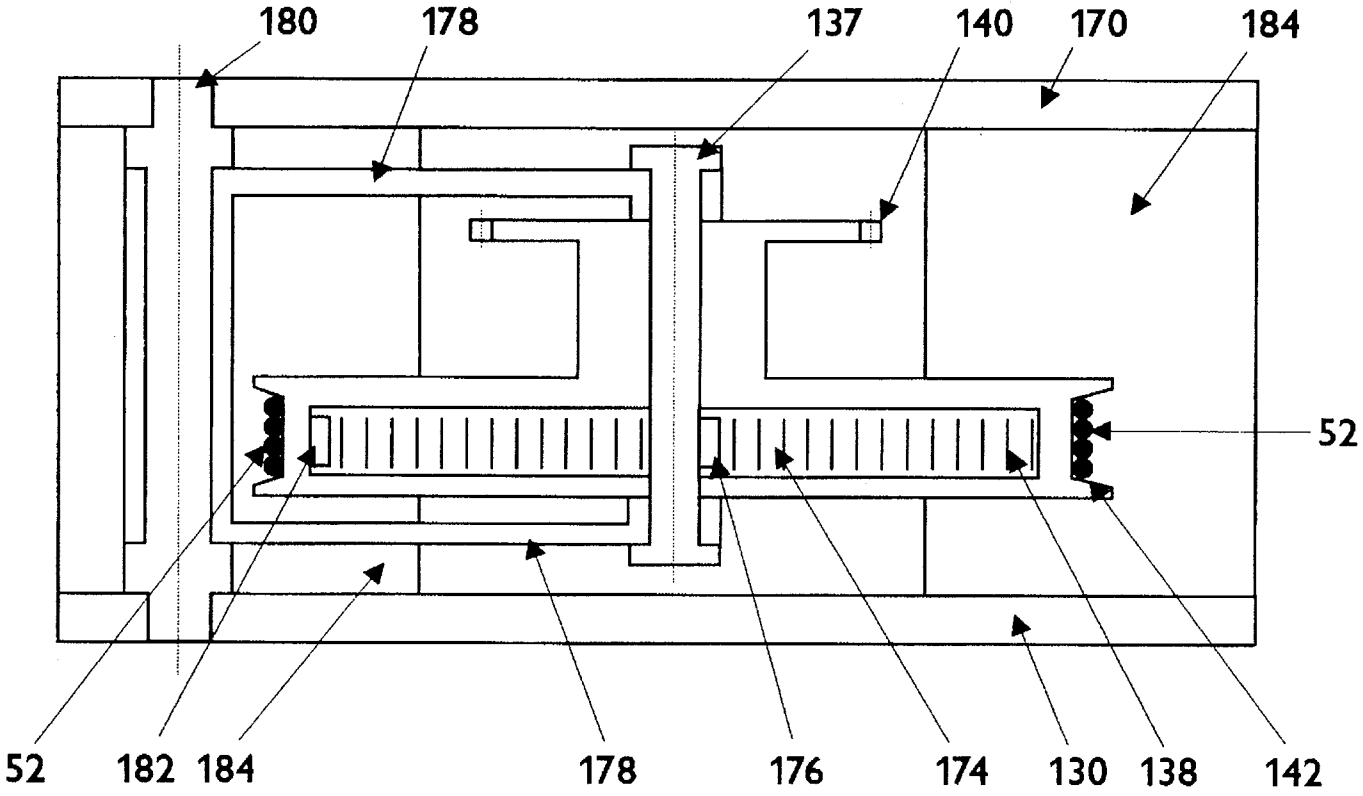
FIG. 7 is a cross-section view of the accommodating resistance system taken along line A—A of FIG. 6.

Referring to FIGS. 5–7 wherein the accommodating resistance system 58 is shown. It should be noted that the accommodating resistance system 58 hereinafter described is similar to that of the accommodating resistance systems 84, 102 and 120 identified heretofore. In one embodiment, the resistance system 58 comprises a base member 130 adapted to support a variety of components of the system and to serve as a mounting means so that the resistance system 58 may be embedded within the platform 12. Disposed at one end of the base member 130 are a plurality of sheaves or pulleys 134 which are adapted to movably guide and support the cable 52 as it moves inward and outward of the resistance system 58.

The resistance system 58 further comprises a drive gear wheel 136 formed with a flywheel 140 that is rotatably mounted about a pin or shaft 137. As best shown by FIG. 7, the upper and lower end of the shaft 137 are secured to a support bracket 178 which is disposed above the base member 130 by a pin 180. The above arrangement allows the drive gear wheel 136 to rotate without interference with the base member 130.

The drive gear wheel 136 is provided with an external annular channel 142 adapted to receive and retain the cable 52 in a wound manner. As the drive gear wheel 136 is rotated counter-clockwise as indicated by arrow c (FIG. 6), the cable 52 is caused to unwind from the channel 142. In contrast, as the drive gear wheel 136 is rotated clockwise as indicated by arrow d, the cable 52 is caused to be wound upon the channel 142. The drive gear wheel 136 is further provided with an internal cylindrical cavity 138 which contains a recoil spring 174. One end of the recoil spring 174 is attached to the shaft 137 at a point 176 while the other end of the recoil spring 174 is connected to the cylindrical cavity at a point 182.

The resistance system 58 further comprises a disengagement spring 144 having one end connected to an upward extending member 146 fixed upon an end of base member 130. The other end of the disengagement spring 144 is connected to the shaft support bracket 178. The drive gear wheel 136 with fly wheel 140 is laterally moved between an "engaged position" where the lower end of the shaft 137 abuts a protrusion 148 and a "disengaged position" where the shaft 137 abuts a protrusion 150. In the engaged position, the flywheel 140 is engaged with a driven gear wheel 152 (to be described) whereby the drive gear wheel 136 can only rotate in the counter-clockwise direction and under a resistance provided by a resistance means (to be described). In the disengaged position, the flywheel 140 is separated or disengaged from the driven gear wheel 152 whereby rotation of the drive gear wheel 136 is limited or controlled by the force of the recoil spring 174.

When the cable 52 is pulled by a person with a force greater than the spring force of spring 144, the drive gear wheel 136 with flywheel 140 is moved to it's engaged position and rotated in a counter-clockwise direction. Rotation of the drive wheel 136 in a counter-clockwise manner causes the recoil spring 174 to become "loaded." When the person releases the cable 52 and/or otherwise the force on the cable 52 is less than the spring force of spring 144, the drive wheel gear 136 is caused to move to it's disengaged position wherein the force stored within the recoil spring 174 causes the drive gear wheel 136 to move in a clockwise direction to thereby rewind the cable 52 upon channel 142.

Driven gear wheel 152 is rotatably mounted about a shaft 154 and comprises a plurality of teeth (not shown) which are adapted to engage with corresponding teeth (not shown) formed as part of the flywheel 140. The driven gear wheel 152 and the flywheel 140 become engaged about an axis 156. The shaft 154 is securely mounted to an upper plate 170 which is securely attached to the base member 130 by the pin 180 and plate spacers 184. The driven gear wheel 152 is connected to the resistance means (to be described) by a coupling link 168 having one end rotatably connected to the driven gear wheel 152 about a pin 172. The other end of the coupling link 168 is rotatably connected to a piston 156 (to be described) of the resistance means about a pin 170.

The resistance means comprises a hydraulic chamber 154 filled with an incompressible fluid medium 180 such as hydraulic fluid. The hydraulic chamber 154 is formed with a spacer 166 which separates the hydraulic chamber 154 into a cavity 164 and a channel 162. The channel 162 is defined to have a width w and has a volume less than that of cavity 164.

The resistance means further comprises a relief valve 160 which may be extended into and/or retracted from the channel 162 of the hydraulic chamber 154. Relief valve 160 is provided with the knob 60 so that a person can selectively increase or decrease the resistance in infinitely small increments by increasing or decreasing the width w of channel 162.

The resistance means further comprises a piston 156 having one end rotatably connected about the pin 170 to the coupling link 168. The movement of piston 156 is restricted to a lateral direction indicated by arrow p by a pair of bearings (not shown) mounted within walls 186 and 188 of the hydraulic chamber 154. The bearings are provided with appropriate seals to contain the fluid medium 180 within the hydraulic chamber 154. The piston 156 comprises a flange 158 which is disposed within the cavity 164 of the chamber 154. The flange 158 is preferably formed so that it completely spans the full width and height of the cavity 164 to prevent fluid medium 180 from passing through the flange 158 as the piston 156 is laterally moved within the cavity 164.

When the relief valve 160 is fully retracted from the channel 162, the width w of channel 162 is at it's maximum width. In this position, there is little resistance to movement of the piston 156 within the hydraulic chamber 154. When the relief valve 160 is partially extended into the channel 162, the width w of channel 162 is decreased and flow of the fluid medium 180 through the channel 162 is restricted thereby providing resistance to the movement of the piston 156 within the hydraulic chamber 154. When the relief valve 160 is fully extended into the channel 162, the relief valve 160 is caused to abut the spacer 166 and the width w of the channel 162 is reduced to zero which completely prevents the flow of any fluid through channel 162. This is a position of maximum or infinite resistance and the piston 156 cannot be moved under any applied force thus preventing the flywheel 136 and the cable 52 from unwinding.

In operation, a person may select a desired resistance by turning the knob 60 which causes the relief valve 160 to be either inserted into or retracted from the channel 162. Thereafter, when the person applies a pulling force on the cable 52 which exceeds the spring force of the engagement spring 144, the drive gear wheel 136 is moved into engagement with driven gear wheel 152 which restricts rotation of the drive gear wheel 136 to that of the resistance selected by the person. When the person has completed a given movement of cable 52 and then releases the cable 52 or otherwise reduces the pulling force to less than the spring force of the engagement spring 144, the drive gear wheel 136 becomes disengaged from the driven gear wheel 152 wherein the cable 52 is rewound upon the channel 142 by the loaded recoil spring 174.

Thus, the loaded recoil spring 174 is working to store cable 52 on the flywheel 136 when no pulling force is applied to the rope. Furthermore, the flywheel also allows the delivery of the additional cable necessary during exercise. The loading ability of this spring is negligibly small. The resistance of the system is defined by the resistance to movement of piston 156 within the hydraulic chamber 154. Compared with conventional resistance systems based on friction and springs, this system provides accuracy and stability which depend neither on pad wear, loading characteristics of a spring, or differences between coefficients of static and dynamic friction. With the resistance system according to the invention, the load preset by knob 60 will be the same at any length of cable 52. This gives the possibility to perform endurance tests or research with maximal accuracy and result reliability without using additional instruments to measure load at any given period of time and/or during the movement.

With the exercise machine 10 of the present invention, a person may perform a variety of different cardiovascular or strength training exercises. Moreover, the exercise machine 10 can easily be adjusted to meet the ergonomic profile of the person. FIGS. 8–32 illustrate a few of the exercise routines which may be performed by a person using the exercise machine 10. The embodiment and nomenclature of FIG. 4 will be used in the description of FIGS. 8–32.

Figure 8:
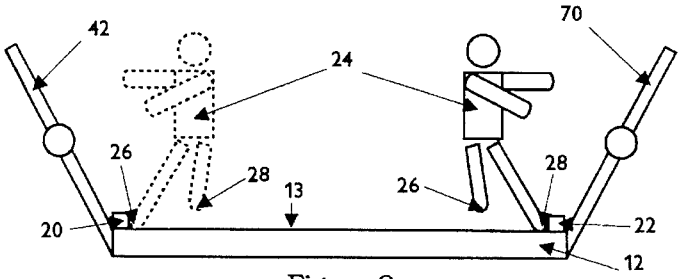
FIGS. 8–32 are illustrations showing various exercise routines which may be performed with the exercise machine of the present invention.

FIG. 8 is an illustration of a person 24 performing a sliding exercise wherein the person 24 would initiate the sliding exercise by pushing off of stopper 22 with his/her foot 28 and leading with foot 26, the person may slide on both feet across the exercise surface 13. The person is caused to slide the full sliding distance d until the person's foot 26 is brought into contact with the stop member 20. Thereafter, the exercise may be repeated by the person pushing off of stop member 20.

Figure 9:
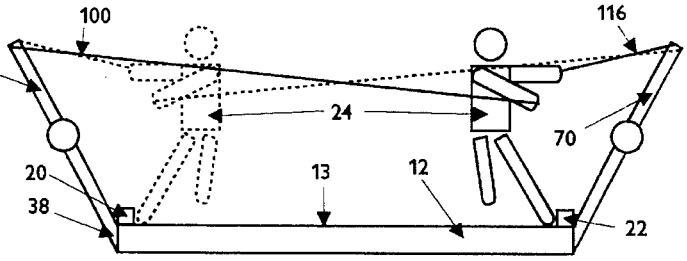
Figure 10:
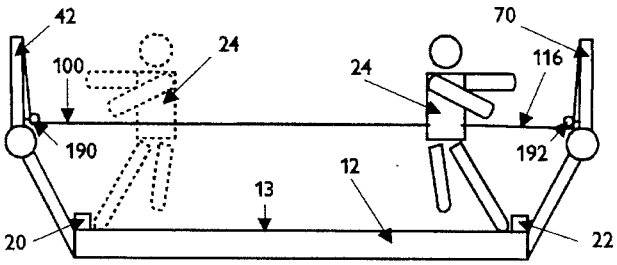
Figure 11:
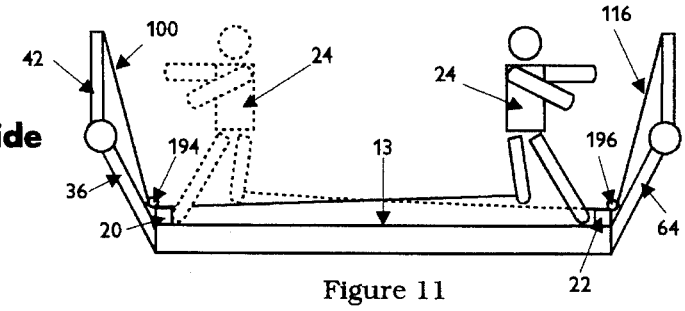

As shown by FIGS. 9–11, a person 24 may perform a sliding exercise while exercising his/her arms (FIG. 9), waist (FIG. 10) or legs (FIG. 11). This exercise routine may be performed, for example, by the person attaching the cables 100 and 116 to the respective body portion while performing the sliding routine. The energetic expenditure required by this exercise is higher than by sliding alone. Various pulleys 190, 192, 194, and 196 are preferably used to thereby allow the cables to be positioned in a technically correct position relative to the person's body.

Figure 12:
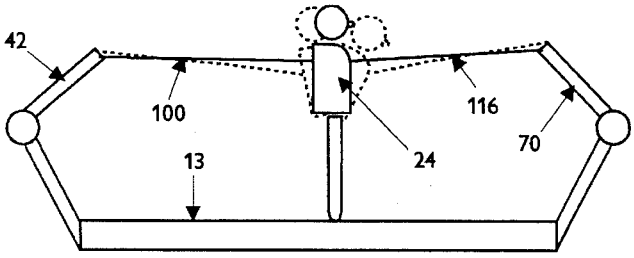
Figure 13:
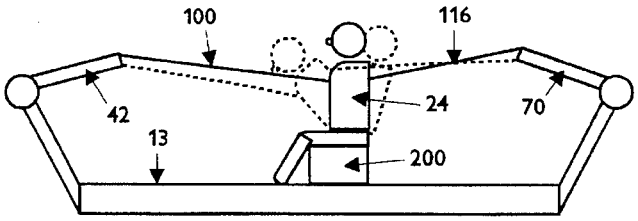

The exercise machine 10 of the present invention may also be used for a variety of resistance exercise routines. As shown by FIG. 12, a person 24 may perform a flexion and extension exercise on his/her lower back by connecting cables 100 and 116 to the upper back portion of the person 24 by a belt (not shown). Similarly, and as shown by FIG. 13, a person 24 could perform a flexion and extension exercise on his/her back portion in a sitting position by providing a seat 200 on the exercise surface 13. Note that both of these exercise routines are performed in a "push-pull" fashion.

To exercise a particular muscle group in a "push-pull" fashion requires that resistance be applied in both directions of motion. Conventional equipment does not allow a person to exercise in a "push-pull" fashion. For example, lifting a hand-held twenty pound (20 lb) weight uses only a "push" motion. On the way up, the contraction of the muscle must be sufficient to overcome the effect of gravity to lift the weight. Once the weight is at its apogee, the agonist muscle need only slowly relax to control the descent of the weight. That is, the antagonist of the upward movement never contracts to become the agonist of the downward stroke. In the push-pull configuration of the present invention, the limb must be actively pushed up and pulled down to perform one full motion. This feature provides numerous advantages over conventional exercise equipment. On such advantage is that the person may reduce the workout time in half by allowing two sets of opposing muscles to be worked during one movement.

Figure 14:
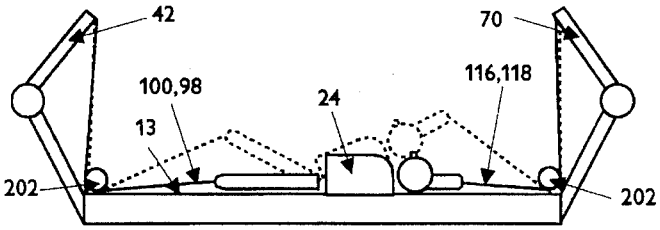

As shown by FIG. 14, a person 24 may perform only a flexion exercise on one of his/her foot and arms by connecting cables 98 and 100 to one leg and cables 116 and 118 to one arm. In this application, four (4) pulleys 202 (only two are shown) are disposed on both ends of the platform 12 to thereby allow the cables to be positioned in a technically correct position relative to the person's foot and arm.

Figure 15:
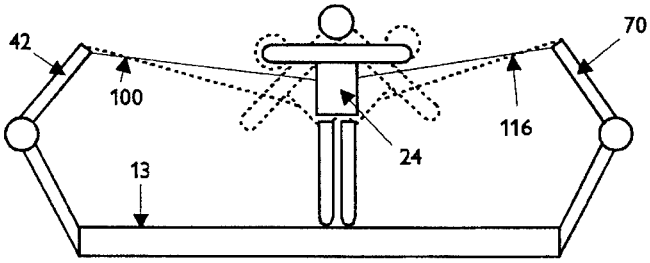

As shown by FIG. 15, a person 24 may perform a lateral flexion exercise by attaching cables 100 and 116 to their waist.

Figure 16:
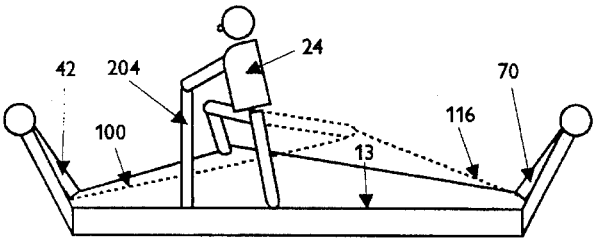
Figure 17:
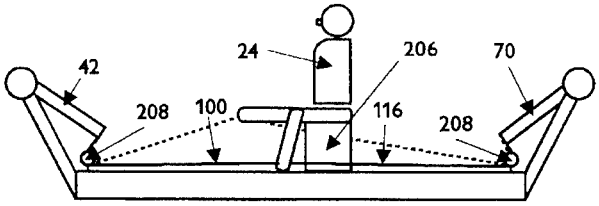
Figure 18:
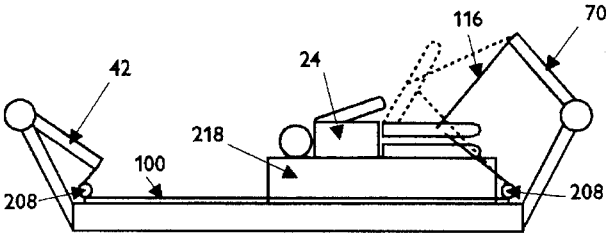
Figure 19:
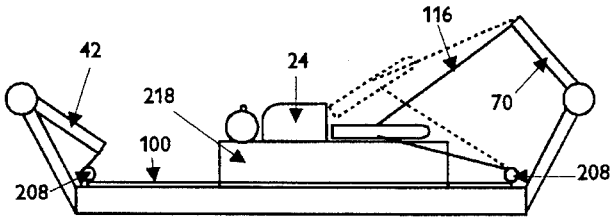
Figure 20:
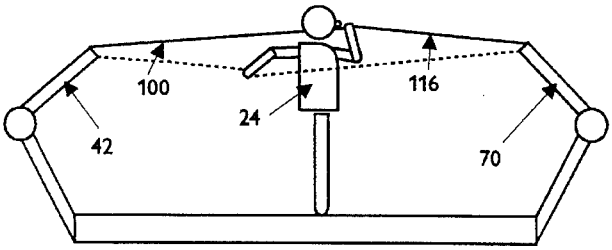
Figure 21:
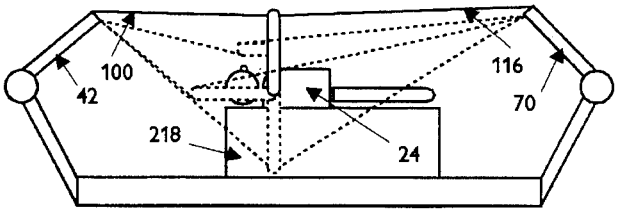
Figure 22:
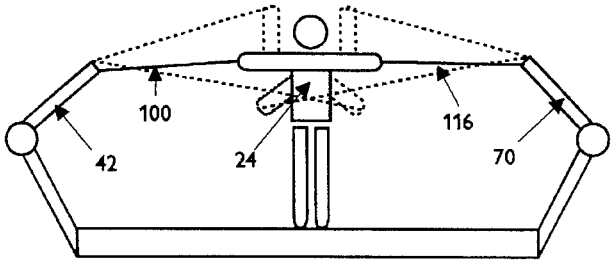
Figure 23:
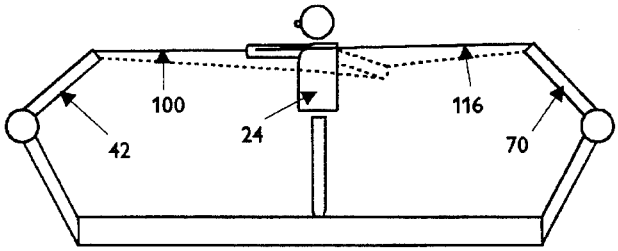

As shown by FIGS. 16–19, a person may perform a variety of exercises for his/her lower body. As shown by FIG. 16, a person could perform a hip extension and flexion by standing on the exercise surface 13 and leaning against a support member 204 and thereafter attaching the cables 100 and 116 to one of the person's foot. In this exercise routine, the person is exercising in a push-pull fashion thereby working the agonist and antagonist muscles in one complete motion or cycle. As shown by FIG. 17, a person could perform a knee extension and flexion by sitting on a chair 206 while exercising a given leg. Note the passage of the cables through the pulleys 208 to provide a technically correct exercise position. As shown by FIG. 18, a person could perform a hip abduction and adduction by laying flat and on his/her side upon a support member 218 and connecting the cables 100 and 116 to one of their legs. In this application, the cable 100 is passed through both of pulleys 208. As shown by FIG. 19, the person could perform a hip flexion by laying on flat on his/her back and connecting cable 100 to one leg and cable 116 to the other leg. In this application, the cable 100 is also passed through both of pulleys 208.

As shown by FIGS. 20–23 a person may perform a variety of upper body resistance exercises.

Figure 24:
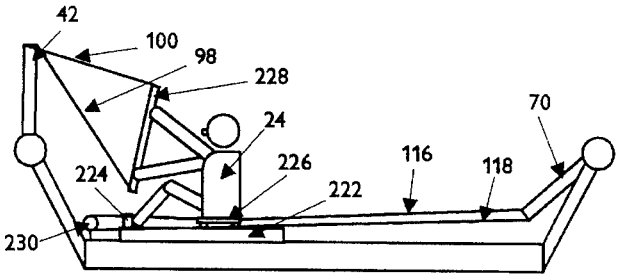

As shown by FIGS. 24–31, a person may perform a variety of other exercises. As shown by FIG. 24, a person could perform a rowing and kayaking program. In this embodiment, the exercise machine 10 may further comprise a stationary support 222 having a foot support 224 and a seat 226 which is optionally movable thereon. In this application, cables 100 and 98 are attached to a bar 228 which may be grasped by the person 24. Cable 116 is attached to one side of the seat 226 and the cable 118 is attached to the other side of seat 226 through a pulley 230.

Figure 25:
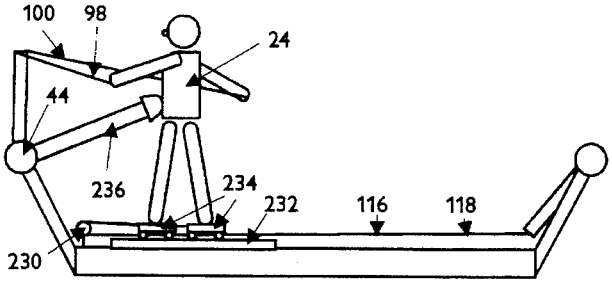

As shown by FIG. 25, a person could perform a power walk and/or simulate a cross country skiing session. In this embodiment, a platform 232 may be provided with a pair of grooves (not shown) adapted to allow the person's feet or a pair of simulated skis 234 to slide therein. The grooves are preferably made of the same material as the exercise surface 13 so that a person wearing woven socks or a pair of skis having a woven bottom surface would slide within the grooves. The exercise machine 10 may further comprise a cushioned support bar 236 rotatably attached to the joint 44 which extends outward to support the waist area of the person 24. In this embodiment, cables 100 and 98 would be grasped by the person's arms by a handle (not shown). At the option of the person, cables 116 and 188 could be attached to each of the person's legs or to the simulated skis 234. One cable for each leg would be passed through the pulley 230 to provide a push-pull movement. Alternatively, a person could perform the above exercise without the use of any cables attached to their legs.

Figure 26:
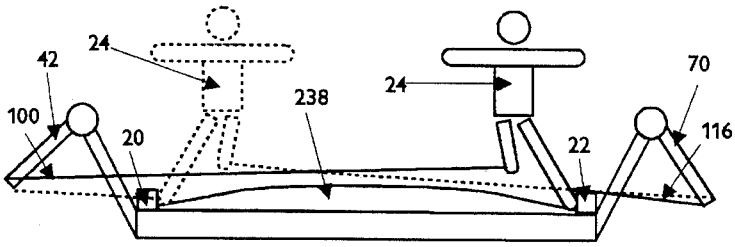

As shown by FIG. 26, a person 24 could simulate an alpine skiing session. In this embodiment, the exercise machine 10 would further comprise a concave shaped surface 238 removably disposed over the platform 12 and which is made covered with the same material as the exercise surface 13. With the attachment of cables 100 and 1116, a person could slide across the concave surface 238 under resistance to simulate alpine skiing.

Figure 27:
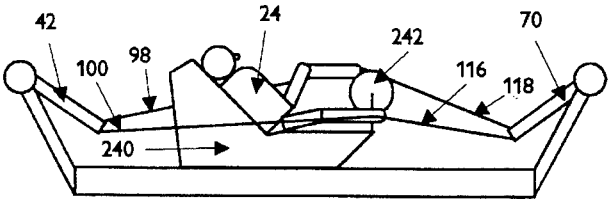

As shown by FIG. 27, a person 24 could simulate a cycling session in a semi-reclined position. In this embodiment, a person would be positioned in a seat 240 and have his/her feet drive a wheel 242 while resistance would be applied by cables 100 and 116 attached to one leg and cables 99 and 118 attached to the other leg.

Figure 28:
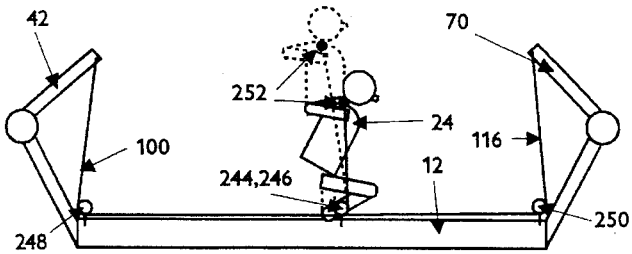

As shown by FIG. 28 a person could perform a squat exercise using a bar 252. In this embodiment, the exercise machine 10 would further comprise a pulleys 244 and 246 disposed at the center of the platform 12 and pulleys 248 and 50 positioned at the end of the platform.

Figure 29:
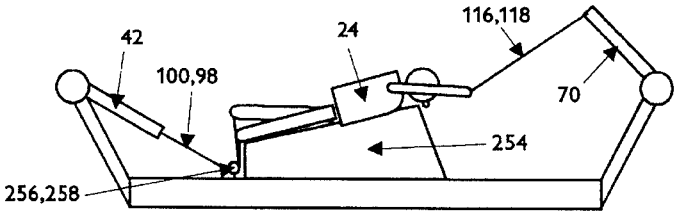

As shown by FIG. 29, a person could simulate a swimming program. In this embodiment, the person may lay flat on an inclined support platform 254. Cables 100 and 98 would be passed through pulleys 256 and 258, respectively and connect to each of the person's feet whereas cables 116 and 118 would be connected to each of the person's hands.

Figure 30:
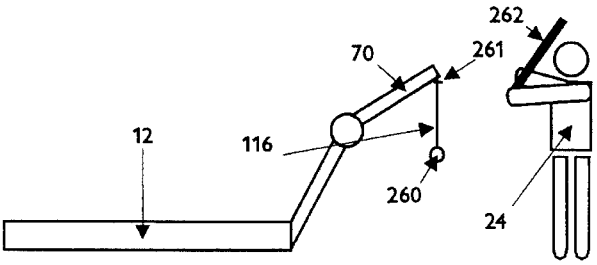
Figure 31:
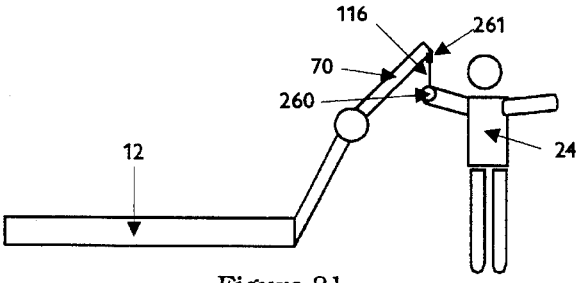

As shown by FIG. 30, a person 24 could practice various swings used in games such as a baseball, hockey, golf and/or tennis. In this embodiment, the exercise machine 10 would further comprise a ball 260 attached to the cable 116 which would be hit for example with a baseball bat or tennis racket 262. A clip 261 is provided to prevent the cable 116 from rolling back within the pulley. If the upper segment 70 were lowed, a golf ball or hockey puck could be struck by the person. Similarly, as shown by FIG. 31, a person 24 could practice a variety of throwing motions such as those used with a baseball, shot put or javelin.

Figure 32:
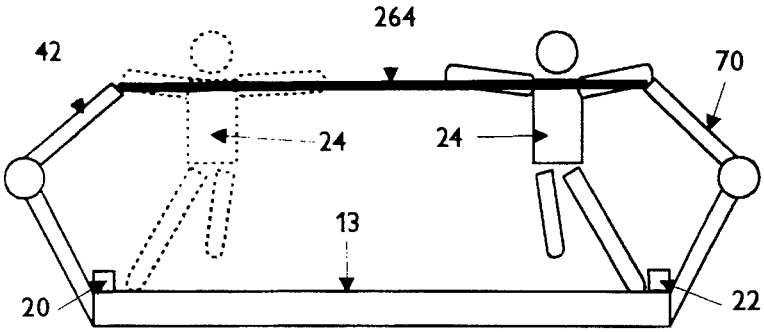

Further, as shown by FIG. 32, the exercise machine 10 of the present invention could further comprise a bar 264 connected across upper segments 42 and 70. With this embodiment, for example, a person could use the bar 264 while learning to perform the sliding exercise. Alternatively, an injured person could use the bar 264 for therapeutic purposes to ease the strain caused by gravity on an injured limb.

Following are only a few of the advantages offered by the exercise machine 10 of over conventional exercise machines. First, the exercise machine 10 can in a single machine provide anyone with a complete exercise program, including cardiovascular, strength exercises, and coordination to meet their fitness goals. Second, the exercise machine 10 can easily be adjusted to meet the ergonomic profile of the individual person. Third, a person may exercise a particular muscle group in a "push-pull" fashion in a single full movement. Fourth, the exercise machine 10 allows a person to infinitely vary the resistance and moreover obtain a high resistance without using large and/or heavy weights. Fifth, the exercise machine 10 is a substantially isokinetic system which does not use electrical energy to control the resistance. Sixth, a person may exercise while applying different resistances to up to four different body segments at the same time. Seventh, a person may benefit from the use of video and/or bio-feedback either while exercising or at rest. Further, the exercise machine 10 is a safe and reliable system because of it's elegant design and avoidance of electrical energy and heavy weights. Furthermore, the exercise machine 10 is essentially noiseless and the avoidance of weights and/or rubber bands makes it very safe.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. An exercise machine for training both muscle strength and cardiovascular endurance comprising:

(a) a support platform comprising a removable middle module and a pair of end modules;

(b) a plurality of stop members disposed on said end modules;

(c) a plurality of arm members movably connected to said support platform;

(d) a resistance means (e) a plurality of cables each having one end connected to said resistance means and a second end extending from said arm member;

said resistance means further comprising a first member to store said cables, a movable drive member adapted to retain said first member, a driven member, means for moving said drive member into an engaged position with said driven member, and hydraulic means comprising a housing having a cavity and a channel and a piston therein connected to said driven member, said housing filled with incompressible fluid for providing resistance against said movement of said driven member when said drive member and said driven member are in an engaged position; whereby a user exercises by pulling the cables against the resistive force generated by said resistance means.

2. The exercise machine of claim 1, wherein said hydraulic means further comprises a valve adapted so that the cross section of said channel can be varied.

3. The exercise machine of claim 1, wherein said first member of said resistance means has an internal cavity containing a recoil spring, and an external channel containing said cable, such that it is unwound from said channel, the spring force applied to said cable is substantially less than the force of the resistance of said hydraulic means.

4. The exercise machine of claim 1, wherein said support platform comprises a sliding surface with low coefficient of friction when in contact with a woven material, and said sliding surface is integral to said plurality of end modules and said removable module.

5. The exercise machine of claim 1, wherein said arm members each comprise an upper segment and a lower segment, said upper segment being pivotally connected to said lower segment, and said lower segment being pivotally connected to said support platform.

6. The exercise machine of claim 1, wherein said arm members each further comprise a horizontal member rotatably connected to said upper segment of said arm member, and a plurality of extension members movably connected to said horizontal member.

7. The exercise machine of claim 1, wherein each said extension member further comprises a pulley rotatably mounted to said extension member to support said cable from said resistance means.

* * * * *